United States Patent [19]

Kühnert

[11] 4,012,927

[45] Mar. 22, 1977

[54] LOOP TRANSFERRING CAM SYSTEM FOR FLAT KNITTING MACHINES

[75] Inventor: Gottfried Kühnert, Aalen, Germany

[73] Assignee: Universal Maschinenfabrik Dr. Rudolf Schieber KG, Westhausen, Germany

[22] Filed: Sept. 9, 1975

[21] Appl. No.: 611,757

[30] Foreign Application Priority Data

Sept. 10, 1974 Germany ..... 2443231

[52] U.S. Cl. ..... 66/78

[51] Int. Cl.[2] ..... D04B 7/00; D04B 15/36; D04B 35/00

[58] Field of Search ..... 66/78, 67, 70, 73, 76

[56] References Cited

UNITED STATES PATENTS

| | | | |
|---|---|---|---|
| 2,718,130 | 9/1955 | Hafner | 66/78 X |
| 3,514,976 | 6/1970 | Joseph | 66/78 |
| 3,605,450 | 9/1971 | Goller et al. | 66/78 |
| 3,615,145 | 10/1971 | Goller et al. | 66/78 |

*Primary Examiner*—Ronald Feldbaum
*Attorney, Agent, or Firm*—Sughrue, Rothwell, Mion, Zinn & Macpeak

[57] ABSTRACT

A flat knitting machine has two opposed needle beds and rigid loop expanders are provided on the needles. Loop transferring cam sets mounted on the traversing machine carriage include a transfer cam having at least three noses of which at least one is higher than the others. The higher nose lifts the needles sufficiently for the knitted loops held on the needles of one bed to be expanded on the loop expanders and the other noses complete transfer of the loops to the needles in the other bed. The loops open the latches of the receiving needles as they are transferred.

4 Claims, 8 Drawing Figures

LOOP TRANSFERRING CAM SYSTEM FOR FLAT KNITTING MACHINES

BACKGROUND OF THE INVENTION

1. Field of the Invention

The invention relates to a flat knitting machine having two opposed needle beds, and a carriage traversible along the beds, and more particularly to a system for transferring loops from the needles of one of the needle beds to the needles of the other needle bed.

2. Description of the Prior Art

A loop transferring cam system of the kind comprising a transfer cam having one nose and a receiving cam having two noses of different heights on the carriage has already been described, as for instance in German Pat. No. 660,568. This loop transferring cam system permits loop transfer to be effected only when the carriage traverses in one direction, whereas for expanding the loops that are to be transferred the needles from which the loops are transferred as well as the needles which are to receive loops must be lifted. Satisfactory loop transference and simultaneous knitting action during the same carriage traverse is impossible of attainment with this prior art system of cams.

Completely symmetrical loop transferring cam systems have also been proposed which permit loops to be transferred in a leading or trailing position to the stitch cam system during carriage traverse. These loop transferring cam systems comprise transfer cams having two noses of equal height, the leading nose in either direction of carriage traverse being used for expanding the loops that are to be transferred and the trailing nose being used for actually effecting the transfer. Loop transferring cam systems of this design have the drawback that loop expansion is not satisfactory when needles fitted with loop expanders are used.

Another problem which arises in loop transfer is that previously special devices were needed for opening the latches on the loop receiving needles. The flat knitting machine described in German Pat. No. 660,568 also requires a special device for opening the latches.

A known device for opening the latch on the receiving needle is a wire hook attached to the carriage and adapted with its point to slide along the underside of the comb of the tracked needle bed and to engage the needle directly below the needle hook. The external shape of the wire hook is such that it will retract the latch and retain it in open position during the following transferring action. In order to permit the wire hook to move into the required position the needle bed comb must be considerably undercut and in consequence weakened. If the wire loop has been slightly bent by some minor bump the latches will cease to open as required and they may even be damaged.

An alernative device for opening the latches on the receiving needles consists of flat or round brushes affixed to the carriage. However, even these brushes are not entirely reliable in opening the latches because they cannot retain the open latches during loop transference since the receiving needle is not lifted higher than into tuck position and the latch in this position is still inside the comb of the bed and behind the transferring needle which is in clearing position.

Another known method of opening the latches of the receiving needles uses magnets attached to the carriage, but this is a complex and expensive arrangement. Finally, it has been proposed for instance in the published specification of German Patent Application No. 1,585,391 to open the latches by means of the opposing needles. This has the drawback that during traverse of the carriage in one direction it is impossible to knit and to transfer loops at the same time.

SUMMARY OF THE INVENTION

It is an object of the present invention to provide a loop transferring cam system of the above specified kind which permits the loops to be transferred from the needles of the front needle bed to the needles of the back needle bed or conversely or in both directions during the same carriage traverse from right to left or from left to right before or after the needles have knitted or tucked or drawn no fresh loops.

According to the invention this object is achieved by the provision of rigid loop expanders on the needles and of a cam set comprising a transfer cam having at least three consecutive noses in the direction of carriage transverse, of which at least one nose is higher than the other nose or noses. The higher nose of the transfer cam permits the loop that is to be transferred to be satisfactorily and reliably expanded, whereas the lower nose which follows in either direction of traverse moves the needles into their transferring positions proper.

Conveniently the transfer cam may have three noses of which the nose in the middle is higher or lower than the two noses on both sides. The transferring needles are lifted by the lower noses to a sufficient height for the closed latches on the receiving needles to be opened by the transferred loops themselves as they slide over the receiving needles. Consequently, no special device for opening the latches is needed.

The higher nose causes the loop that is to be transferred to be suitably expanded and the following lower nose gives it the form required for transfer in which it is capable of opening the latch on the receiving needle. The proposed loop transferring cam system according to the invention thus permits the latches of the receiving needles to be opened automatically by the loops that are being transferred.

Different heights of the noses of the transfer cam are also absolutely necessary when needles are used which are also required to knit during the same carriage traverse as that in which they are to transfer loops to empty needles.

For the purposes of loop transference the needles of the front and of the back needle beds on the flat knitting machine are so opposed that they slide closely past each other when they are lifted. For effecting expansion of the loops the needles are provided with lateral loop expanders. When these needles are lifted for the purpose of loop transfer their loops must be expanded to ensure that the receiving needles and their hooks can reliably enter the loops which are about to be transferred. Satisfactory contact between the loops and the loop supporting shoulders on the transferring needles is possible only if the actual transferring action is preceded by a loop expanding action; the design of the transfer cam according to the invention enables this to be done. The higher nose functions as a loop expanding nose, whereas the lower nose functions as the loop transferring nose.

As the latches on the receiving needles must be open during the actual loop transferring action, the transferring needles must not be raised higher in the transferring stage by the transfer cam than will permit the loops resting on their loop supporting shoulders to slide over the hooks of the receiving needles and to open the still closed latches on the receiving needles.

The transfer cams in the front and back loop transferring cam sets are preferably symmetrically disposed with reference to the longitudinal center line of the cam carriage.

Moreover, with advantage, the cam carriage fitted with the proposed loop transferring cam system is so designed that each lower nose of the transfer cam of one of transferring cam sets is following by an up-throw cam for the receiving needles of the opposite cam set, the action ranges of the lower nose and of the up-throw cam of the receiving set at least partly overlapping.

The height of the higher or expanding nose, is determined by the needle gauge of the knitting machine.

BRIEF DESCRIPTION OF THE DRAWINGS

Preferred embodiments of the invention will now be more particularly described with reference to the accompanying drawings in which.

DETAILED DESCRIPTION OF THE PREFERRED EMBODIMENTS

Figure 1:
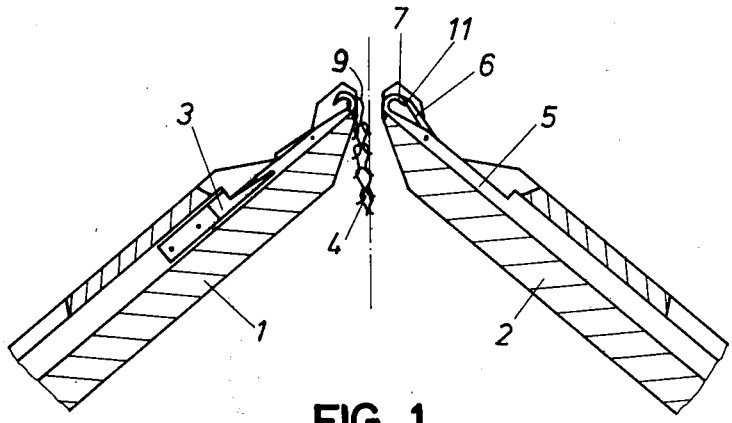
FIG. 1 is a partial cross-section of the front and back needle beds in a flat knitting machine.

FIGS. 1 to 6 are partial cross-sectional views of a flat knitting machine at consecutive stages in the operation of transferring a loop of knitted fabric from a needle in one of two opposed needle beds to a needle in the other needle bed.

The knitting machine shown comprises a front needle bed 1 having needles 3 and a back needle bed 2 having needles 5. A carriage, not shown, in FIGS. 1 to 6, is traversible along the needle beds and includes stitch cams for controlling the operation of the needles 3 and 5 to produce a knitted fabric 4. The carriage also includes loop transferring cam sets 12 and 13 as shwon in FIGS. 7 or 8 which are operative to cause the transfer of a loop 9 from a needle bed 1 to a needle 5 in the back needle bed 2.

In FIG. 1 the transferring needle 3 in the front needle bed 1 carries the knitted fabric 4 and the needle is in its rest or non-knitting position. The hook of the needle 3 is open. In other words, the latch hangs down and is received into the stem of the needle. The receiving needle 5 in the back needle bed 2 is likewise in non-knitting position but it holds no fabric. The needle 5 has a latch 6 which rests on the point of the needle hook 7 so that the hook is closed.

Figure 2:
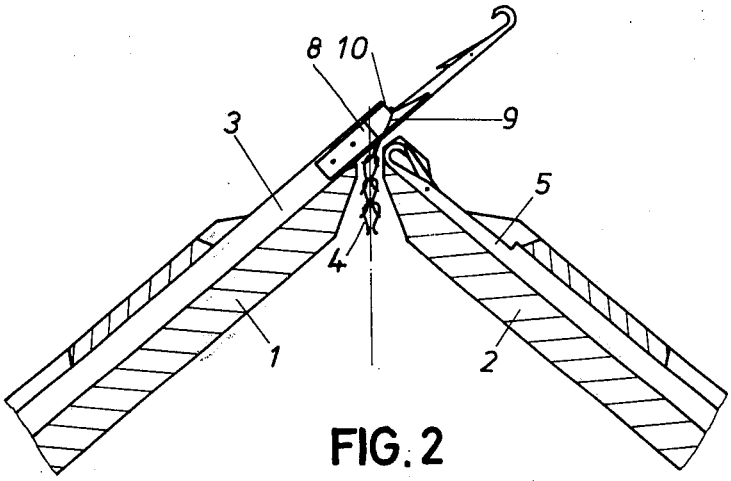
FIGS. 2 to 6 are, respectively, partial cross-sections similar to FIG. 1 but showing the needles in different positions during the transfer of loops by the proposed loop transferring cam system.

FIG. 2 shows the next stage in the transfer of a loop from needle 3 in the front needle bed 1 to 5 in the back needle bed 2. The position of needle 5 in the back needle bed 2 is still the same as in FIG. 1, but needle 3 has been lifted by a higher nose, i.e., the loop expanding nose 25 on a transfer cam 23 (see FIGS. 7 and 8) into a loop expanding position. The loop expanding position is the highest position of the needle 3 during its loop transferring motions. In this position the loop 9 of the fabric 4 that is to be transferred rests on a loop supporting shoulder 10 and is fully expanded by an expander 8 attached to one side of the needle.

Figure 3:
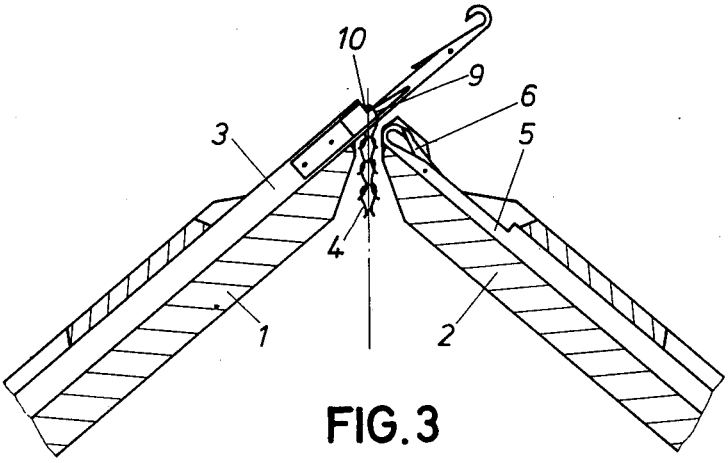

In the stage shown in FIG. 3 the needle 3 has been slightly lowered from its position in FIG. 2. It now rests on a lower nose, i.e., the transfer nose 26 of the transfer cam 23 and it is in its loop transferring position proper. In this position the loop 9 that is to be transferred is able in the course of the transferring action to open the latch 6 of the receiving needle 5. The position of needle 5 is still the same as that which it occupied in FIGS. 1 and 2.

Figure 4:
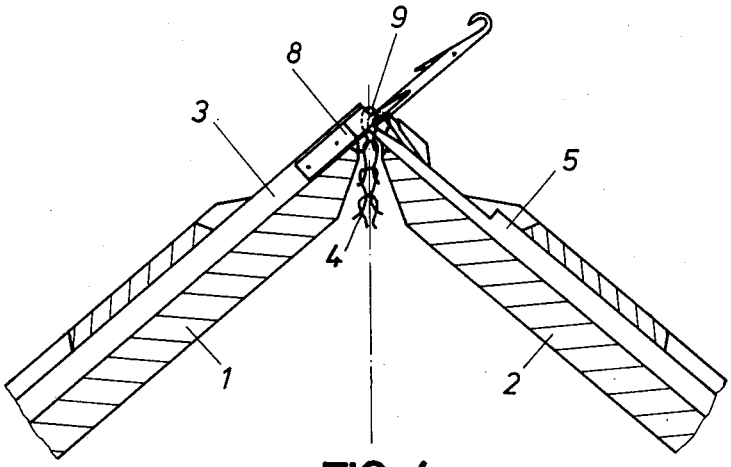

In FIG. 4 the transferring needle is in the same position as in FIG. 3. In other words, it is still held by the transfer nose 26 in loop transferring position. The receiving needle 5 is now in a position immediately prior to being lifted by a cam associated with the back needle bed 2, for instance, by the transfer cam 21 shown in FIG. 7. The needle 5 has entered the gap between the expander 8 and the needle 3 and faces the expanded loop 9 on needle 3.

Figure 5:
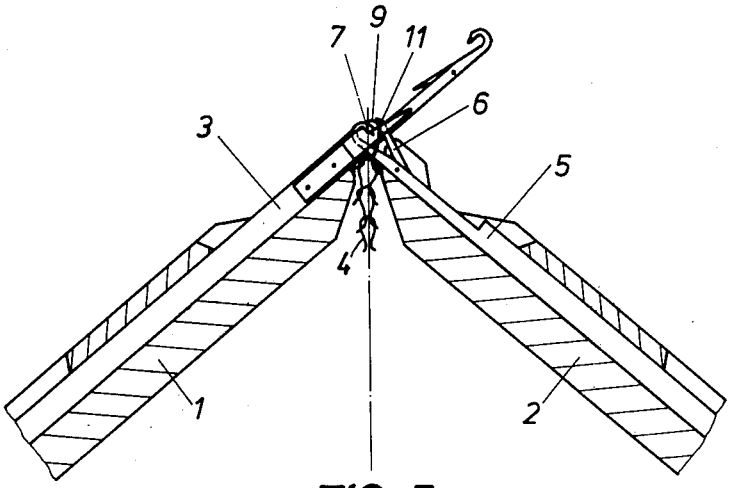

In FIG. 5 the position of needle 3 is still unchanged in loop transferring position, but the receiving needle 5 has been raised further, causing the transferred loop 9 to slide over the needle hook 7 and to open the latch 6.

Figure 6:
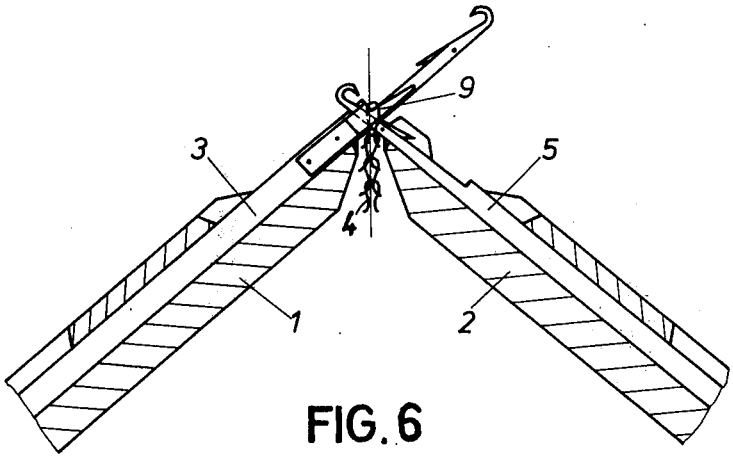

In FIG. 6 the transferring needle 3 is still in transferring position, but the receiving needle 5 has now been lifted to the highest position necessary for retaining the loop 9. If first needle 3 and the needle 5 are lowered the transferred loop 9 will remain hanging in the hook of needle 5 for further knitting.

Figure 7:
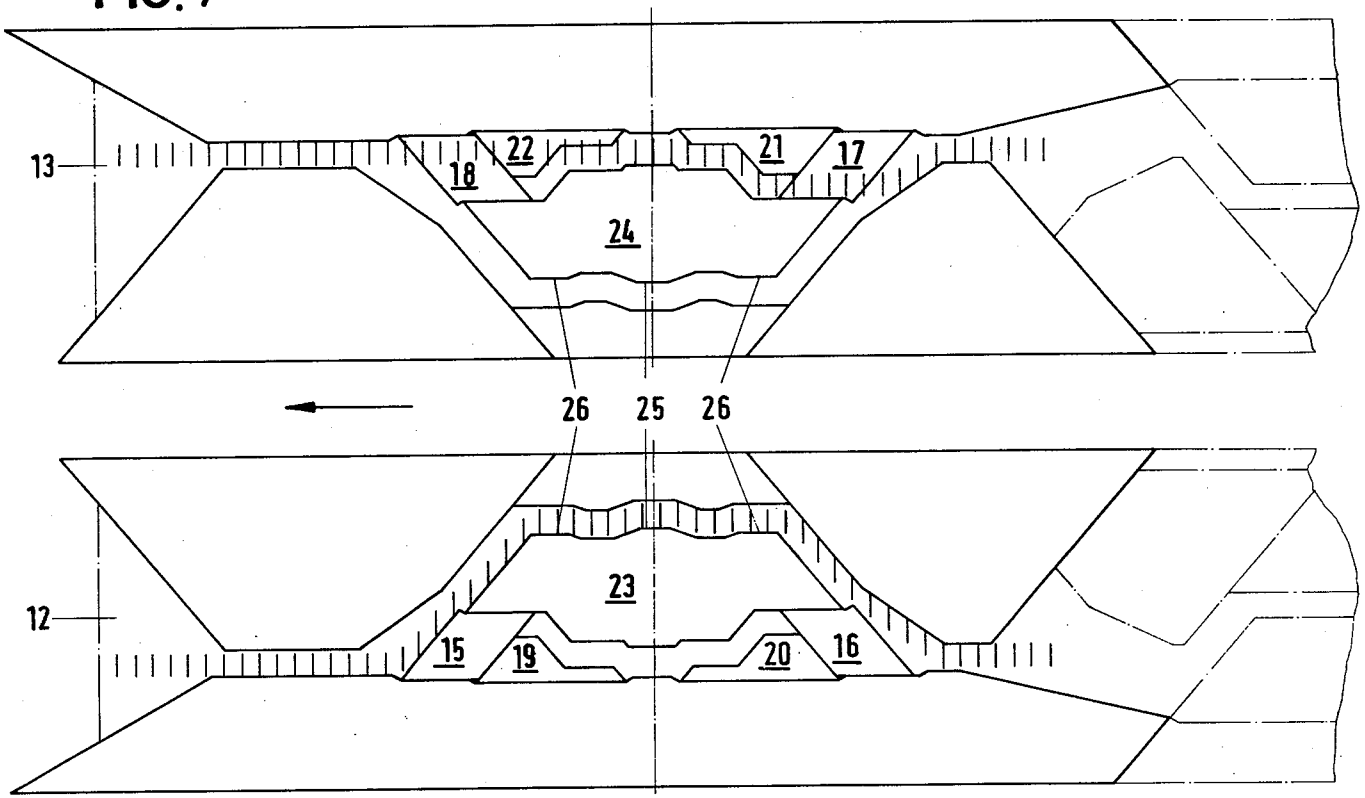
FIG. 7 is a diagrammatic plan view of a front and back loop transferring cam set.

FIG. 7 is a schematic plan view of a front loop transferring cam set 12 and of a back loop transferring cam set 13. These loop transferring cam sets 12 and 13 are mounted on the cam carriage of the flat knitting machine on the left and right hand sides alongside the associated stitch cam sets. Their purpose is to impart the necessary movements to the needles 3 and 5 in the front and back needle beds 1 and 2 to cause a loop 9 to be transferred from needle 3 to needle 5 in the manner that has been described with reference to FIGS. 1 to 6. The loop itself causes the latch 6 of needle 5 which covers the point of the needle hook 7 with its spoon 11 to be automatically opened as exemplified in FIG. 5 Loop transfer with the aid of the loop transferring cam sets 12 and 13 takes place during carriage traverse to the right or left in leading or trailing position.

FIG. 7 shows that the front transferring cam set 12 contains a transfer cam 23 having an expanding nose 25 and symmetrically preceding and following the same a lower transfer nose 26 with depressions of equal depth between nose 25 and each nose 26. For lifting a needle that is to receive a loop, receiving cams 19 and 20 are provided. Furthermore, cams 15 and 16 serve to guide the needles to the transfer cam 23.

The back loop transferring cam set 13 is symmetrical with reference to the center axis of the carriage to the front loop transferring cam set 12. Instead of the transfer cam 23 in the front cam set 12 a transfer cam 24 is provided and comprises one loop expanding nose 25 and two transfer noses 26 which are lower than the expanding nose. The back loop transferring cam set 13 further comprises cams 17 and 18 which correspond to the cams 15 and 16 as well as receiving cams 21 and 22 which correspond to the receiving cams 19 and 20. The needle butts are represented in FIG. 7 by short parallel lines.

When the carriage traverses for instance from right to left and the loops are transferred from front to back, as assumed in FIG. 7, then the needles 3 are guided either by cam 15 or by a jacquard mechanism directly to the transfer cam 23. The needles 3 are driven over the leading transfer nose 26 and lifted to clearing height. They are then brought back by the expanding nose 25 to loop expanding height and finally by the trailing transfer nose 26 to transferring and latch opening height. During this needle movement from the expanding nose 25 to the trailing transfer nose 26 the needles 5 in the back needle bed 2 are thrown up by cam 21 into position for receiving the loop. It will be clearly observed that cam 21 in the back cam set 13 follows the trailing transfer nose 26 in the front cam set 12 and that the working ranges of the trailing transfer nose 26 in the front cam set 12 and of cam 21 in the back cam set 13 overlap.

If the cam system illustrated in FIG. 7 is to transfer all the loops from the needles 3 in the front needle bed to the needles 5 in the back needle bed 2, then the cams 17 and 18 and the receiving cam 22 in the back cam set 13 must be inactivated. If only specified needles 3, e.g., needles in the front bed selected by a jacquard mechanism are to transfer their loops to needles 5 in the back needle bed, then the cams 15 and 16 as well as the receiving cams 17 and 18 and the receiving cam 22 in the back cam set 13 must be inactivated.

Figure 8:
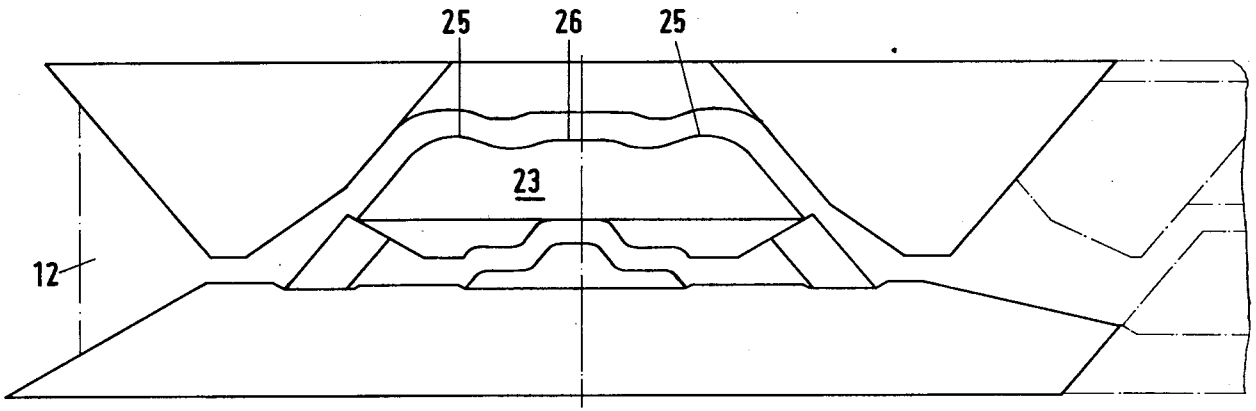
FIG. 8 is a schematic plan view of a different embodiment of a front loop transferring cam set.

FIG. 8 illustrates an alternative embodiment of a front loop transferring cam set 12. The associated back cam set 13 is correspondingly designed. In the modified loop transferring cam set 12 in FIG. 8 there is provided a transfer cam 23 which has a single lower transfer nose 26 and and leading as well as trailing higher loop expanding noses 25 with depressions of equal depth between nose 26 and each nose 25. The other cams of the set are adapted to the modified design of the transfer cam 23. Moreover, the loop transferring action generated by the modified transfer cam 23 corresponds to that already described with reference to FIGS. 1 to 7.

The height of cam 25 is determined in accordance with the needle gauge.

What is claimed is:

1. In a flat knitting machine having opposed needle beds including a plurality of latch-type needles having rigid loop expanders secured thereto and a carriage traversible along said beds including cam means for knitting and for transferring loops from the needles of one needle bed to the needles of the other needle bed during the traverse of the carriage, said cam means comprising a pair of cam sets on the carriage cooperable with the needles of each needle bed respectively, each of said cam sets including a transfer cam having a higher nose for expanding the loops and a following lower nose for transferring the loops, the improvements comprising each cam set including a transfer cam having at least three noses which are consecutive in the direction of traverse of the carriage and having depressions of equal depth between adjacent noses, said transfer cam including a spaced complementary opposed cam for camming the needles into each depression, said three noses including at least one higher nose followed by at least one lower nose for opposite directions of traverse by said carriage and receiving cams adapted to lift the receiving needles associated with said transfer cam in the opposite cam set for both directions of traverse by said carriage whereby the lower nose following said higher nose for each direction of traverse is adapted to left the needles from which loops are to be transferred high enough for the closed latches of the needles which are to receive the loops to be opened by the loops as they slide over the receiving needles.

2. In a knitting machine as set forth in claim 1 wherein the transfer cam has three noses of which the nose in the middle is higher than the nose on either sie.

3. In a knitting machine as set forth in claim 1 wherein the transfer cam has three noses of which the nose in the middle is lower than the nose on either side.

4. In a knitting machine as set forth in claim 1 wherein the transfer cams in both cam sets are symmetrically disposed with respect to the longitudinal center line of said carriage.

* * * * *